United States Patent [19]

Beikel et al.

[11] Patent Number: 4,493,350

[45] Date of Patent: Jan. 15, 1985

[54] DEVICE FOR REMOVING AIR FROM HERMETIC, AUTOMATICALLY EMPTYING CENTRIFUGE DRUMS

[75] Inventors: Alfons G. Beikel, Ahlen; Harald Jarosch, Warendorf, both of Fed. Rep. of Germany

[73] Assignee: Westfalia Separator AG, Oelde, Fed. Rep. of Germany

[21] Appl. No.: 479,784

[22] Filed: Mar. 28, 1983

[30] Foreign Application Priority Data

Apr. 13, 1982 [DE] Fed. Rep. of Germany ..... 3213618

[51] Int. Cl.[3] ..... B65B 31/04; B65B 3/26

[52] U.S. Cl. ..... 141/65; 141/192; 141/95; 141/39; 137/389; 222/64

[58] Field of Search ..... 141/65, 66, 67, 94, 141/95, 4–7, 37, 39, 192, 198, 59, 57, 52; 137/386, 389; 222/56, 64, 69, 411

[56] References Cited

U.S. PATENT DOCUMENTS

| | | | |
|---|---|---|---|
| 976,688 | 11/1910 | Pindstofte | 141/59 |
| 2,059,455 | 11/1936 | Hoar | 141/51 |
| 2,565,045 | 8/1951 | Ray | 141/51 |
| 3,181,556 | 5/1965 | Baker | 137/389 |
| 3,763,901 | 10/1973 | Viland | 141/52 X |
| 3,782,400 | 1/1974 | Hardison et al. | 137/389 X |
| 4,006,762 | 2/1977 | Badger | 137/386 X |
| 4,148,334 | 4/1979 | Richards | 137/389 |

FOREIGN PATENT DOCUMENTS 470723 1/1929 Fed. Rep. of Germany .

*Primary Examiner*—Stephen Marcus
*Assistant Examiner*—Ernest G. Cusick
*Attorney, Agent, or Firm*—Sprung, Horn, Kramer & Woods

[57] ABSTRACT

A device for removing air from hermetically sealed, automatically emptying centrifuge drums and consisting of an air-removal valve atop a reservoir with a manometric switch and a level-sensitive switch and connected to controls. The controls open the valve when the pressure in the reservoir exceeds a predetermined level and close it when the pressure drops below that level. The valve closes however, as soon as the level of the liquid in the reservoir reaches the level-sensitive switch. The device, which is preferably mounted in the product intake of a hermetically sealed, automatically emptying centrifuge, allows air to be removed automatically without allowing product to escape, foam to form, or oxygen to enter. The reservoir can be thoroughly cleaned automatically.

7 Claims, 1 Drawing Figure

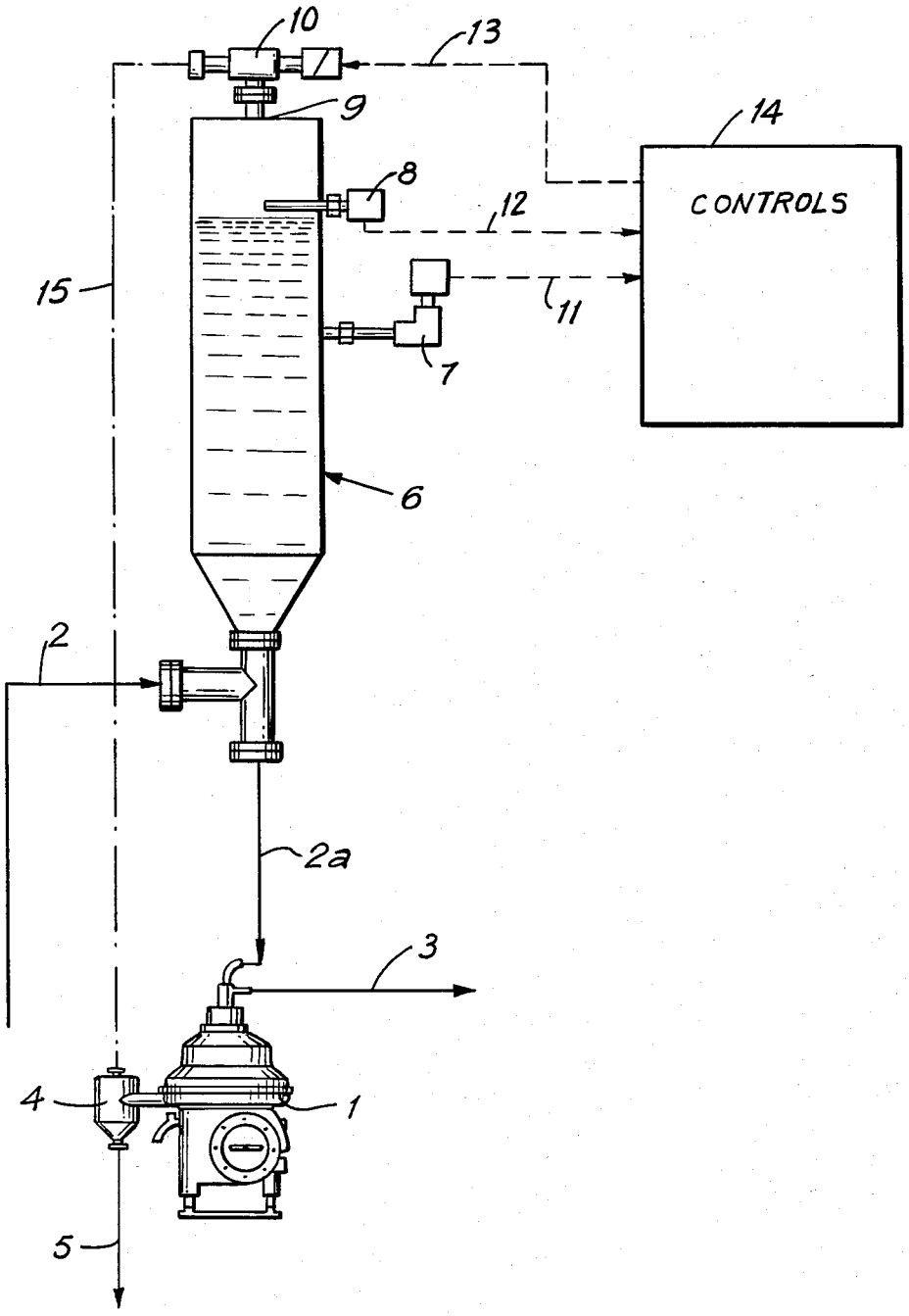
10
13
9
14
CONTROLS
8
12
15
11
7
6
2
2a
3
4
1
5

DEVICE FOR REMOVING AIR FROM HERMETIC, AUTOMATICALLY EMPTYING CENTRIFUGE DRUMS

BACKGROUND OF THE INVENTION

The present invention relates to a device for removing air from hermetically sealed, automatically emptying centrifuge drums in which a rotating drum space is connected to and sealed off from non-moving supply and removal lines by mechanical seals and in which there is an air-removal valve in the supply line for removing air from the drum space.

A device of this type for removing air from hermetically sealed, automatically emptying centrifuge drums is known. It has an air-removal valve in the supply line that communicates through a tube with the space inside the centrifuge drum. German Pat. No. 470 723, for example, discloses a device of this type in a hermetically, completely jacketed centrifuge.

Air must be pumped out of the space inside the hermetically sealed centrifuge drum in a system of this type before it can be charged with liquid. Although some of the air in the drum can, of course, escape directly over the removal line of the centrifuge, the liquid will form a seal between the center of the drum and the solids space as the centrifuge is being filled, leaving a bubble of air in the center. The centrifuge can not be operated unless this bubble can be removed because there will not be enough of a pressure difference between the intake and the outlet unless the center of the drum is completely full of liquid.

Air is removed manually from the space inside the drum through an air-removal valve in the supply line of known hermetically sealed centrifuges, and, since the air-removal tube that communicates with the valve is located near the incoming liquid, liquid can not be prevented from escaping as well while the air is being removed.

Whereas air must be removed from the hermetically sealed, completely jacketed centrifuge disclosed in German Pat. No. 470 723 only once before the commencement of each separation, it must be removed after each emptying in the hermetically sealed, automatically emptying centrifuges preferably employed at the present time. Since such centrifuges are mostly emptied automatically by appropriate controls, the possibility of automating the air removal as well is desirable. The application of an automatic valve to replace the manual controls has been attempted. Such a valve would open for a specific amount of time subsequent to emptying. Since, however, the amount of air entering the drum can vary considerably, it will either not get removed entirely or some of the product will get lost because the valve remains open too long. Furthermore, since the air-removal tube has to be narrow, it takes a relatively long time to remove the air.

Although removing the air from the drum with commercially available air removers that incorporate a float valve and are mounted in the supply line of the centrifuge has accordingly been attempted, it turns out that, if a product tends to foam, the foam will also escape constantly from the air remover because foam, as it rises will not seal off a float valve. Furthermore, known air removers do not prevent oxygen from entering, and this is undesirable in many products. Nor can such air removers be cleaned thoroughly enough automatically.

SUMMARY OF THE INVENTION

The object of the present invention is to provide a device for removing air from hermetically sealed, automatically emptying centrifuge drums that is automatic, that will completely remove the air without allowing any product to escape or oxygen to enter, and that can be thoroughly cleaned automatically.

This objective is attained in accordance with the present invention wherein the air-removal valve is mounted on the head of an air-removal reservoir that has a manometric switch and a level-sensitive switch and is connected to control means, which open the valve when the pressure in the reservoir exceeds a predetermined level and close it when the pressure drops below that level, with the valve closing, however, as soon as the level of the liquid in the reservoir reaches the level-sensitive switch no matter how much pressure is in the reservoir. The control means may effect control pneumatically, hydraulically or electrically by conventional techniques.

The level-sensitive switch is preferably mounted at a certain distance below the head of the air-removal reservoir so that there will always be a cushion of air in the reservoir to prevent liquid from escaping while the air is being removed.

The manometric switch can be mounted above or below the level-sensitive switch.

The functions of both switches are suppressed during automatic cleaning so that the air-removal reservoir can be completely filled with cleaning solution as well as rinsed with the valve open. The air-removal valve will preferably have an independent connection to the cyclone head of the centrifuge so that the cleaning solution can be restored to the cleaning circulation system.

The air-removal valve is large enough to optimize rinsing and air removal.

BRIEF DESCRIPTION OF THE DRAWING

One embodiment of the invention will now be specified with reference to the drawing wherein the FIGURE is a schematic of the device of the present invention.

DETAILED DESCRIPTION OF THE INVENTION

The centrifuge 1 has a product intake 2, a clarified-phase outlet 3, and a cyclone head 4 with a solids outlet 5. An air-removal reservoir 6 is mounted at the highest point of the product-supply line *2a*. Reservoir 6 has a manometric switch 7 and a level-sensitive switch 8. A remotely controlled air-removal valve 10 is mounted on the head 9 of air-removal reservoir 6. Manometric switch 7, level-sensitive switch 8, and air-removal valve 10 are connected by lines 11, 12, and 13 to controls 14. Valve 10 can be connected to cyclone head 4 over a line 15.

When product is supplied to centrifuge 1, the air in the drum of centrifuge 1, in the piping, and in air-removal reservoir 6 is compressed. When the upper switching point, 3 bars for example, at which manometric switch 7 is set is exceeded, controls 14 open air-removal valve 10 until the pressure in reservoir 6 falls below the lower switching point, 2.8 bars for example, at which time switch 7 is set. This procedure repeats until the level of the liquid in reservoir 6 reaches level-sensitive switch 8, at which point valve 10 will remain closed even though the pressure continues to rise.

For the device to function smoothly, the pressure in product intake 2 must always be higher than the point at which manometric switch 7 is set. Once centrifuge 1 has been emptied, air-removal valve 10 will open only when enough air enters for the level of liquid in reservoir 6 to drop below level-sensitive switch 8.

The functions of both switches 7 and 8 are suppressed and valve 10 opened temporarily while the device is being automatically cleaned so that air-removal reservoir 6 can be rinsed out. After cleaning, the cleaning solution will return to the cleaning circulation system through line 15, cyclone head 4, and solids outlet 5.

This air-removal device can be used not only with hermetically sealed, automatically emptying centrifuges, but also for removing air from piping and tubing and from an extremely wide range of equipment.

It will be appreciated that the instant specification and claims are set forth by way of illustration and not limitation, and that various modifications and changes may be made without departing from the spirit and scope of the present invention.

What is claimed is:

1. In a device for removing air from a system having a supply line and a removal line and including an air-removal valve in the supply line, the improvement comprising: an air-removal reservoir connected to the supply line and having a manometric switch and a level-sensitive switch thereto and having a head portion, wherein the air-removal valve is connected to the head portion of the reservoir and control means connected to the switches and the air-removal valve for opening the air-removal valve when the pressure in the reservoir exceeds a predetermined level and closing the air-removal valve when the pressures drops below the level and maintaining the valve closed whenever the level of the liquid in the reservoir reaches the level of the level-sensitive switch regardless of the pressure level in the reservoir.

2. The device according to claim 1, wherein the manometric switch has an upper and a lower setting.

3. The device according to claim 2, wherein the control means opens the air-removal valve when the upper setting of the manometric switch is exceeded and closes the valve when the pressure drops below the lower setting.

4. The device according to claim 1, wherein the level-sensitive switch is mounted at a distance below the head of the air-removal reservoir.

5. The device according to claim 1, wherein the control means includes means for opening the air-removal valve independent of the pressure and level in the air-removal reservoir to effect automatic cleaning.

6. The device according to claim 1, wherein the system comprises a hermetically sealed, automatically emptying centrifuge drum in which rotating drum space is connected to and sealed off from non-moving supply and removal lines in mechanical seals.

7. The device according to claim 6, wherein the air-removal valve has an independent connection to a cyclone head of the centrifuge.

* * * * *